US007784535B2

(12) United States Patent
Wells et al.

(10) Patent No.: US 7,784,535 B2
(45) Date of Patent: Aug. 31, 2010

(54) TOP DRIVE SYSTEMS WITH REVERSE BEND BAILS

(75) Inventors: Lawrence E. Wells, Yorba Linda, CA (US); Brett Gregory Wallihan, Huntington Bch, CA (US)

(73) Assignee: Varco I/P, Inc., Houston, TX (US)

( * ) Notice: Subject to any disclaimer, the term of this patent is extended or adjusted under 35 U.S.C. 154(b) by 365 days.

(21) Appl. No.: 11/823,463

(22) Filed: Jun. 27, 2007

(65) Prior Publication Data

US 2009/0000780 A1 Jan. 1, 2009

(51) Int. Cl.

| | |
|---|---|
| ***E21B 19/00*** | (2006.01) |
| ***E21B 19/22*** | (2006.01) |
| ***E21B 27/00*** | (2006.01) |
| ***A47H 1/10*** | (2006.01) |

(52) U.S. Cl. ..... 166/75.14; 166/77.1; 166/162; 248/318

(58) Field of Classification Search ..... 175/85, 175/162, 207; 294/86; 414/22.51, 22.65; 166/77.1, 75.14; 248/470, 478, 318, 489
See application file for complete search history.

(56) References Cited

U.S. PATENT DOCUMENTS

| | | | | |
|---|---|---|---|---|
| 1,552,527 | A * | 9/1925 | Wilcox | 294/90 |
| 1,690,709 | A | 11/1928 | Wilson | |
| 1,731,128 | A * | 10/1929 | Edwards | 294/102.2 |
| 2,242,783 | A | 5/1941 | Grau | |
| 4,188,141 | A * | 2/1980 | Stoot | 403/24 |
| 4,449,596 | A | 5/1984 | Boyadjieff | 175/5 |
| 4,593,773 | A | 6/1986 | Skeie | 175/85 |
| 4,643,325 | A | 2/1987 | Streit | 220/91 |
| 4,800,968 | A | 1/1989 | Shaw et al. | 175/85 |
| 4,832,552 | A | 5/1989 | Skelly | 414/22.54 |
| 5,107,940 | A | 4/1992 | Berry | 175/85 |
| 5,388,651 | A | 2/1995 | Berry | 175/85 |
| 5,433,279 | A | 7/1995 | Tessari et al. | 173/213 |
| 5,457,850 | A | 10/1995 | Knox | 16/114 R |
| 6,679,333 | B2 | 1/2004 | York et al. | 166/379 |
| 7,222,683 | B2 | 5/2007 | Folk et al. | 175/162 |
| 7,320,374 | B2 * | 1/2008 | Folk et al. | 175/220 |
| 2006/0191690 | A1 | 8/2006 | Severin et al. | 166/379 |
| 2007/0240908 | A1 * | 10/2007 | Brown et al. | 175/85 |
| 2007/0251699 | A1 | 11/2007 | Wells | 166/377 |

OTHER PUBLICATIONS

Tesco Drilling Technology, 500 or 650 HCIS Top Drive, 1998, 2pp., USA.
National Oilwell, Top Drive Drilling System TD500PAC Variable Frequency AC Top Drive, 2002, 6pp., USA.

(Continued)

*Primary Examiner*—Jennifer H Gay
*Assistant Examiner*—James G. Sayre
(74) *Attorney, Agent, or Firm*—Williams, Morgan & Amerson, P.C.

(57) ABSTRACT

A bail support and a top drive system for an oilfield drill rig. The top drive system includes a drive apparatus, and the bails have bodies with upper head portions and two spaced-apart legs. Each leg includes an upper leg portion and a lower leg portion. The upper leg portions are non-parallel to each other and extend from the head portion at an angle to a centerline of the bail. Each lower leg portion extends down from its corresponding upper leg portion in a reverse bend.

17 Claims, 4 Drawing Sheets

OTHER PUBLICATIONS

Joy Petroleum Equpment, Catalog 1978-79, 1977, 3pp. USA.

Varco, Varco General Catalog, 4 pp., 2002 USA.

BJ Hughes Drilling Equipment, BJ 1986-87Oil Field Products and Systems, 5pp. USA.

U.S. Appl. No. 29/288,949, filed Jun. 27, 2007, Wells et al.

* cited by examiner

TOP DRIVE SYSTEMS WITH REVERSE BEND BAILS

BACKGROUND OF THE INVENTION

1. Field of the Invention

This invention is directed to wellbore drilling top drive systems; bails to support parts thereof; and methods of their use.

2. Description of Related Art

The prior art discloses a variety of top drive systems; for example, and not by way of limitation, the following U.S. Patents present exemplary top drive systems and components thereof: U.S. Pat. No. 4,458,768; U.S. Pat. No. 4,807,890; U.S. Pat. No. 4,984,641; U.S. Pat. No. 5,433,279; U.S. Pat. No. 6,276,450; U.S. Pat. No. 4,813,493; U.S. Pat. No. 6,705,405; U.S. Pat. No. 4,800,968; U.S. Pat. No. 4,878,546; U.S. Pat. No. 4,872,577; U.S. Pat. No. 4,753,300; U.S. Pat. No. 6,007,105; U.S. Pat. No. 6,536,520; U.S. Pat. No. 6,679,333; U.S. Pat. No. 6,923,254—all these patents incorporated fully herein for all purposes.

Certain typical prior art top drive drilling systems have a derrick supporting a top drive which rotates tubulars, e.g., drill pipe. The top drive is supported by bails, often on a becket suspended beneath a travelling block beneath a crown block. A drawworks on a rig floor raises and lowers the top drive.

Certain prior art bails for supporting top drives have straight legs in which a three-cornered bail shape imparts stress-inducing bending moments throughout a bail when it is under load often with concentrated high stress locations at lower pin lugs and at a topmost upper bend. As larger and larger top systems have evolved, bails have simply been enlarged and made more massive to accommodate heavier system.

BRIEF SUMMARY OF THE INVENTION

The present invention, in certain aspects, provides a top drive system for wellbore operations, which is suspended by bails having integral dual section legs with adjacent sections at angles to each other (a "reverse bend") to create opposite bending moments which counteract the effects of each other, thereby reducing stress in the bail.

In certain aspects, the present invention discloses a bail with opposed upper leg portions each of which is at an angle (a reverse bend) to a corresponding lower leg portion.

In certain top drives support bails connect to main body lugs of a main body of the top drive using bails according to the present invention with reverse bends results in less stress on the main body lugs.

Accordingly, the present invention includes features and advantages which are believed to enable it to advance top drive bail technology. Characteristics and advantages of the present invention described above and additional features and benefits will be readily apparent to those skilled in the art upon consideration of the following detailed description of preferred embodiments and referring to the accompanying drawings.

In certain aspects, bails according to the present invention with bends in the legs take up less vertical space than similar bails with straight legs. In certain aspects bails according to the present invention which can handle a particular load and/or level of stress have a smaller cross-section than straight-legged bails.

In certain aspects, different parts of a bail according to the present invention are, optionally, larger or more massive in cross-section than other parts; e.g., a top curved portion may be larger in cross-section than leg portions below the top portion.

In certain aspects, using bail legs with bends between leg portions reduces over all stresses in the bail legs and stresses on a main body to which leg lugs are connected are reduced.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious top drive systems, bails to support them, and methods of their use; and Such systems with bails with legs with a reverse bead or dual leg sections at angles to each other and, optionally, with bottom lugs on each leg at an angle to the leg.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

Figure 1B:
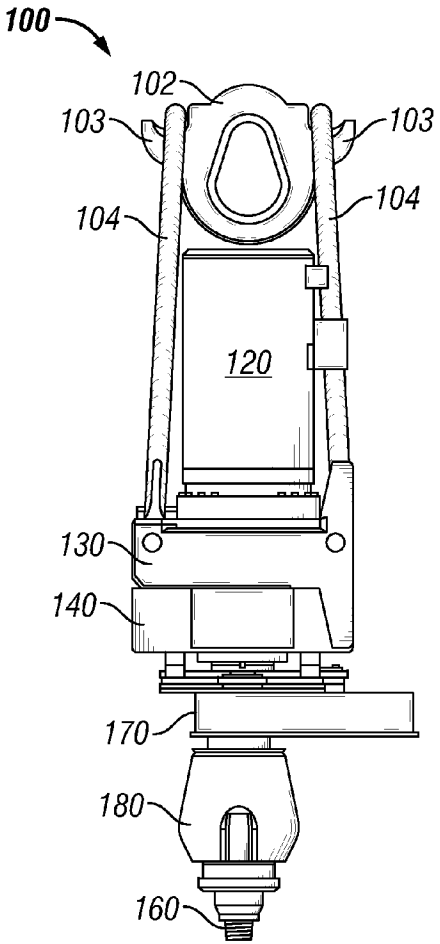
FIG. 1B is a front view of the top drive system of FIG. 1A.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

Figure 1A:
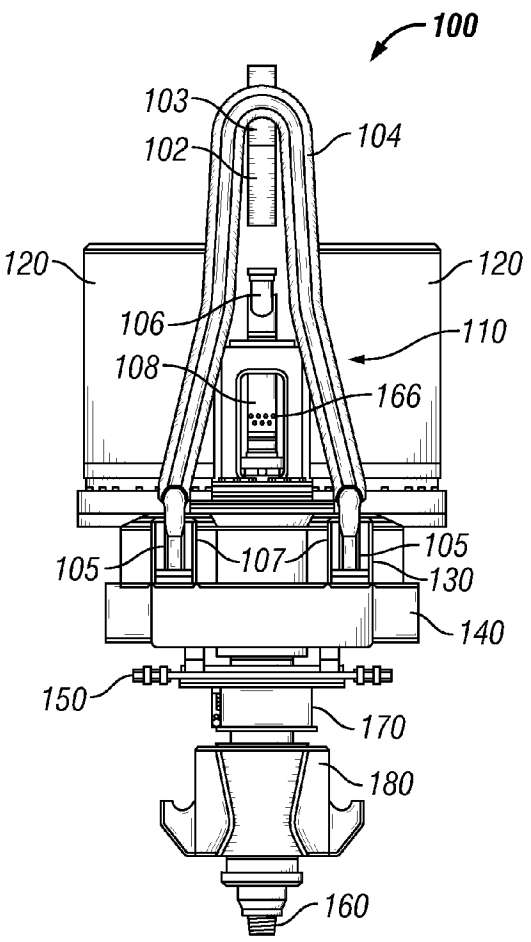
FIG. 1A is a side view of a top drive system according to the present invention.

FIGS. 1A and 1B illustrate a top drive system 100 according to the present invention which has supporting bails 104 according to the present invention suspended from a becket 102. Motors 120 which rotate a main shaft 160 are supported on a main body 130. A bonnet 110 supports a gooseneck 106 and a washpipe 108 through which fluid is pumped to and through the system 100.

A gear system housing 140 is below the motors 120.

A ring gear housing 150 encloses a ring gear 152 and associated components.

An optional drag chain system 170 below the gear system encloses a drag chain and associated components including hoses and cables. Instead of the drag chain system, a rotating head system may be used to provide sufficient rotation for reorientation of a link adapter 180 and items connected thereto.

Upper parts of the bails 104 extend over and are supported by arms 103 of the becket 102. Each bail 104 has two spaced-apart lower ends 105 pivotably connected by pins 107 to the body 130. Such a use of two bails distributes the support load on the main body and provides a four-point support for this load.

Figure 2A:
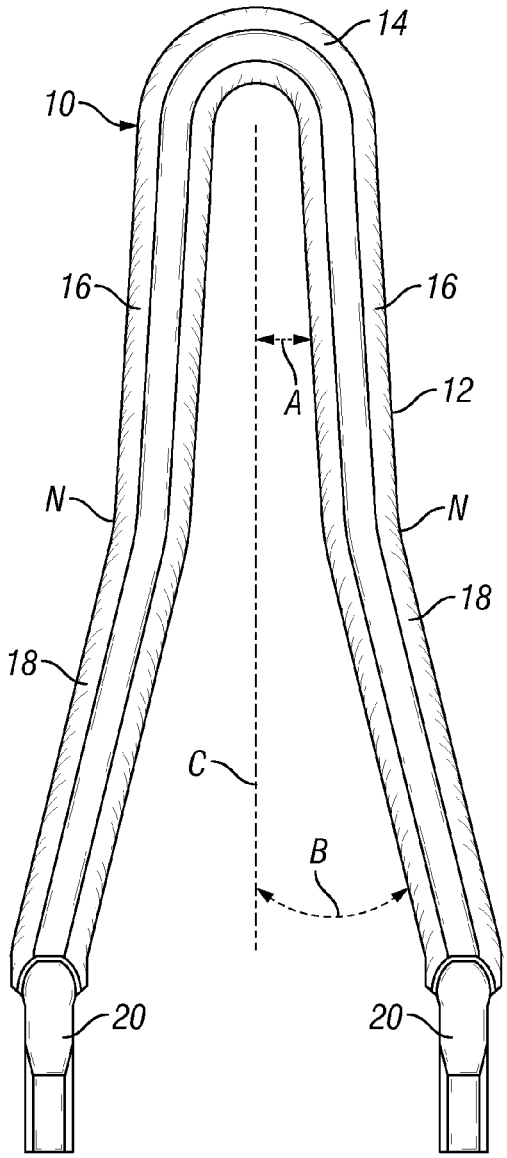
FIG. 2A is a front view of the top drive system support bail according to the present invention.
Figure 2B:
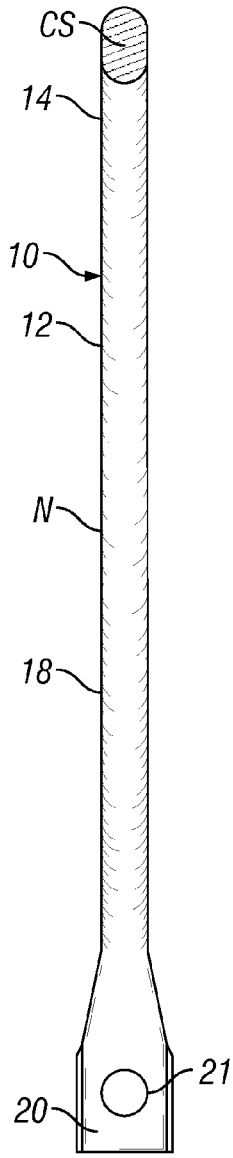
FIG. 2B is a side view of the bail of FIG. 2A.

FIGS. 2A and 2B show a bail 10 according to the present invention (like the bails 104, FIG. 2B) with a body 12 having an upper head 14, upper leg portions 16, lower leg portions 18, and bottom lugs 20 with pin holes 21 therethrough. The upper head portion is curved to accommodate a becket or other support. The upper leg portions 16 are at an angle A with respect to a centerline C of the bail and the lower leg portions 18 are at an angle B to the centerline C. As shown the angle A is 3.5 degrees and the angle B is 13.6 degrees. In certain aspects, and as is true for any bail according to the present invention, the angle A can range between 2 degrees and 7 degrees. In certain aspects, and as is true for any bail according to the present invention, the angle B can range between 12 degrees and 16 degrees. A reverse bend N is formed between the upper leg portions 16 and the lower leg portions 18. As is true of any bail according to the present invention, the reverse bend N may be anywhere along the length of the bail legs (i.e., near the top, near the bottom, or anywhere in between). As is true for any bail according to the present invention, the radius of the reverse bend N can vary between a sharp bend radius (radius=0) to a large radius that eliminates straight segments of the legs. The curvature (length/radius) of the legs without straight sections can be as small as zero (straight leg, infinite radius). The overall height of any bail according to the present invention may be any desired height and the bail width may be any desired width suitable for application to particular equipment, e.g. particular hoisting equipment.

Figure 2C:
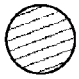
FIGS. 2Ca-2Cg show various cross-sectional shapes for bails according to the present invention.
Figure 2C:
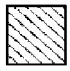
Figure 2C:
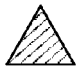
Figure 2C:
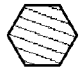
Figure 2C:
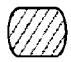
Figure 2C:
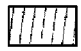
Figure 2C:
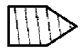

The bottom lugs 20 are parallel to the centerline C. The bottom lugs are at an angle D to the lower leg portions 18. D may range, in certain aspects, between one and forty-five degrees. The bail 10 as shown has a cross-section CS which is generally oval. It is within the scope of the present invention for this cross-section to be any desirable shape (e.g., the shapes shown in FIG. 2Ca-2Cf) This cross-sectional shape may be any shape which satisfies known stiffness and strength criteria based on standard beam design practice. The top curved part is, in certain aspects, curved to match a saddle of a supporting bracket. Upper leg portions may have a cross-sectional shape different from that of the lower leg portions.

FIGS. 3A-3F show a bail 50 according to the present invention which is like the bails of FIGS. 1A and 2A. The bail 50 has a top curved part 52, upper leg portions 54, lower leg portions 56 and lugs 58 with pin holes 59. As shown in FIG.

3G, the bail has a generally oval cross-sectional shape. In certain aspects for the bail 50 the angle A is 5.9 degrees and the angle B is 14.5 degrees; or the angle A is 5.9 degrees and the angle B is 13.8 degrees.

The reverse bends S in the legs create opposite bending moments throughout the bail, partially counteracting the effect of the bending moments which would be present if the legs were straight. The bends create local stresses where they are located, but these are relatively low stresses. By increasing the stresses at the bend locations, the overall maximum stresses (at the lower-leg-/upper-leg-portion interfaces portion and at the lower lugs) are reduced significantly (e.g. in some aspects, by 33%). This allows the use of smaller cross-sections, an overall lighter part using less steel, and one that is, therefore, more economical to manufacture.

Figures 3A, 3B, 3C, 3D, 3E, 3F, 3G:
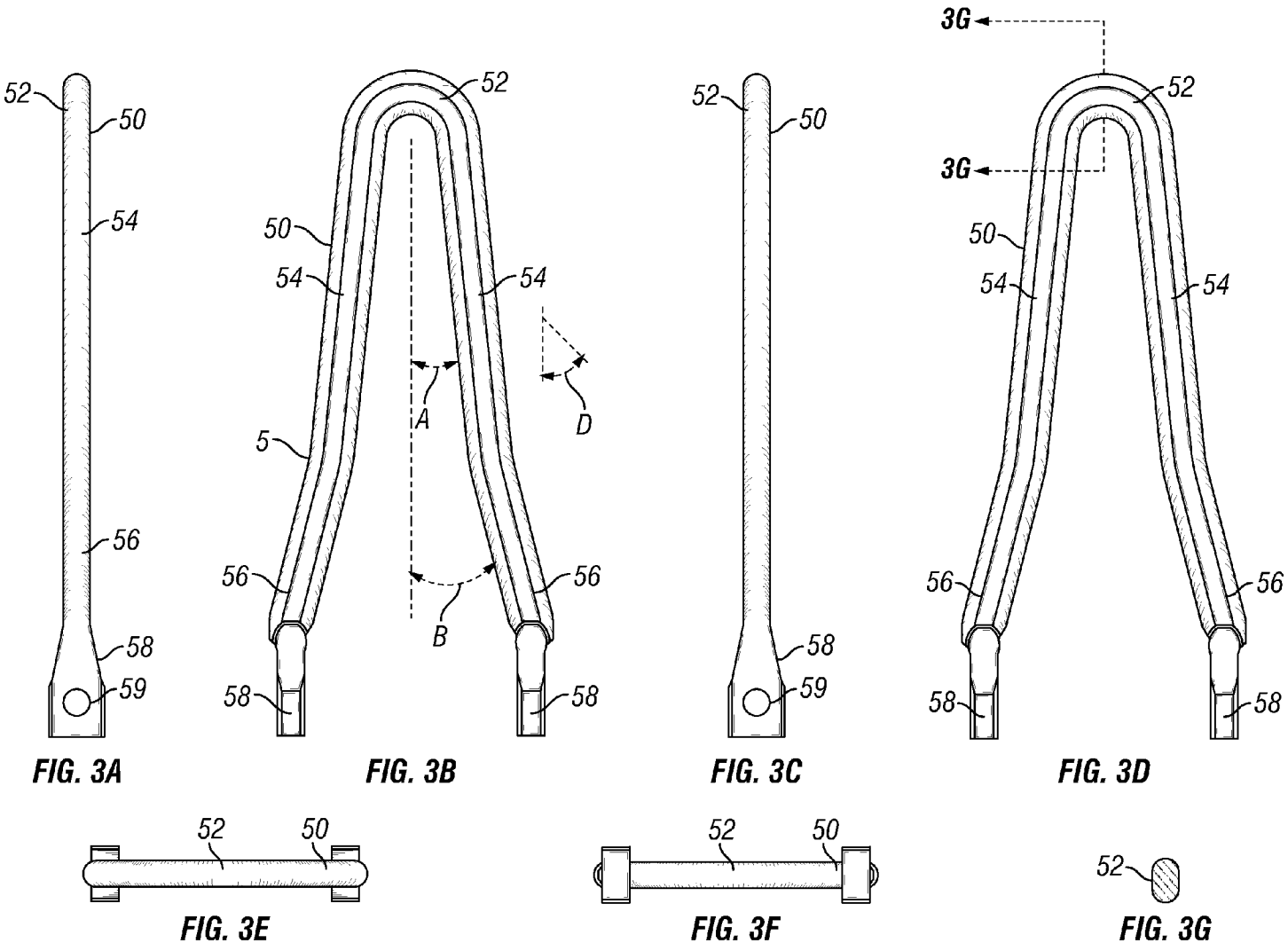
FIG. 3A is a side view of a top drive system bail according to the present invention.
FIG. 3B is a front view of the bail of FIG. 3A.
FIG. 3C is a side view (opposite the side of FIG. 3A) of the bail of FIG. 3A.
FIG. 3D is a rear view of the bail of FIG. 3A.
FIG. 3E is a top view of the bail of FIG. 3A.
FIG. 3F is a bottom view of the bail of FIG. 3A.
FIG. 3G is a cross-section view along line 3G-3G of FIG. 3D.

As shown in FIG. 3G the bails have an oval cross-section. Any suitable cross-section shape may be used including circular (e.g. see FIG. 2C).

Figure 4C:
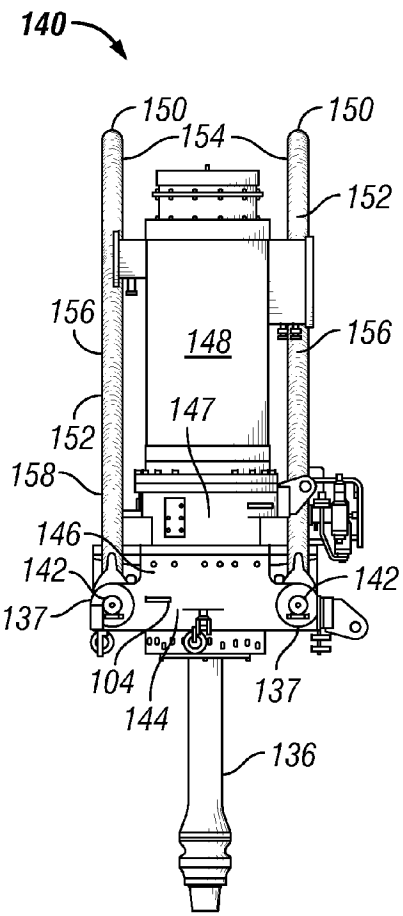
FIG. 4C is a side view of the system of FIG. 4A.
Figure 4B:
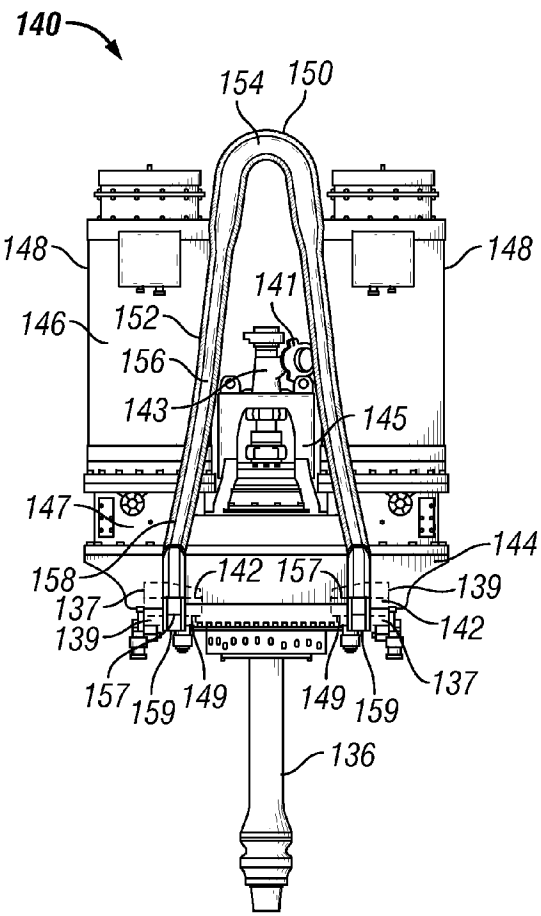
FIG. 4B is a front view of the system of FIG. 4A.
Figure 4A:
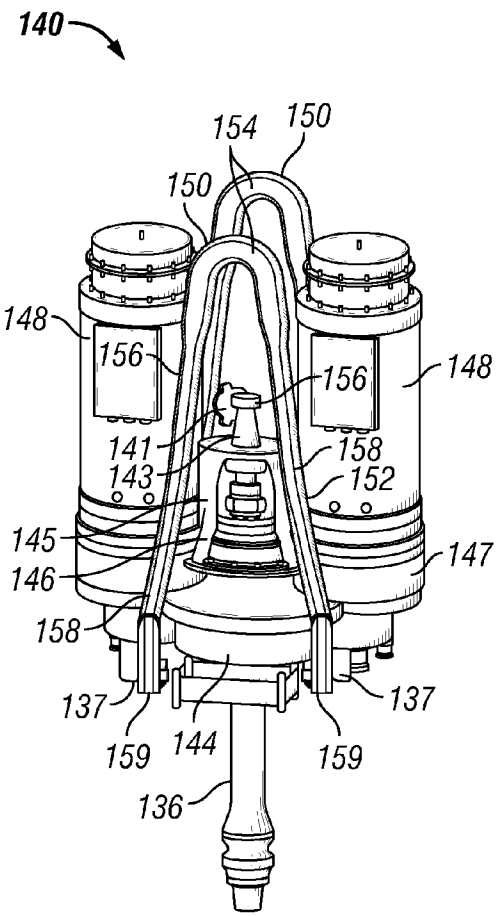
FIG. 4A is a perspective view of a system according to the present invention with bails according to the present invention.

FIGS. 4A-4C show a system 140 according to the present invention with bails 150 according to the present invention. The bails 150 pinned with pins 142 to a main body 104 of a top drive apparatus 146. The top drive apparatus 146 includes motors 148, a gooseneck 141, a washpipe 143, a bonnet 145, and a gear system 147. A top drive shaft 136 is turned by the motors 148.

Each bail 150 has a body 152 with a top curved part 154, upper leg portions 156, lower leg portions 158, and lugs 159. There is a reverse bend between the leg portions 156 and 158. The pins 142 extend through holes 157 in the lugs 159; through holes 139 in projections 137 of the main body 144; and into holes 149 of the main body 104.

It is within the scope of the present invention for the cross-sections of parts of the bails to be similar throughout (top curved part, upper leg portions, lower leg portions); or, as shown in FIGS. 4A and 4B, the top curved part, e.g. part 154, may be larger or more massive in cross-section than the leg portions. In certain aspects, the geometry of the bend is designed to balance the bending moments in the bail ("geometry" refers to the vertical location of the bend and the offset of the bend and "offset" is the distance from the apex of the bend to the theoretical centerline of the leg that would exist if the leg were straight). In such a case when the geometry of the bend balances the bending moments in the bail, the cross-section is constant. In other cases of bend location, e.g. with the bend in a non-ideal location that makes the moments higher at the top of the bail than at the bottom or vice versa, the cross-section at the high moment area (e.g. at or near the top of the bail) is increased to keep the stresses down.

The present invention, therefore, provides in some, but not in necessarily all, embodiments a top drive system for well-bore operations, the top drive system including a top drive apparatus, bails for supporting the top drive apparatus and from which the top drive apparatus is suspended, the bails comprising a first bail and a second bail, each of the first bail and second bail has a body with an upper head portion, the body having two spaced-apart legs, each leg with an upper leg portion and a lower leg portion, the two upper leg portions connected to the upper head portion and projecting down therefrom, the upper leg portions non-parallel to each other and each upper leg portion extending from the upper head portion at an upper angle to a centerline of the bail, and each lower leg portion extending down from a corresponding upper leg portion, each lower leg portion at an angle to its corresponding upper leg portion, and projecting out from the centerline of the bail in a reverse bend with respect to its corresponding upper leg portion, each lower leg portion having a bottom end.

The present invention, therefore, provides in some, but not in necessarily all, embodiments a bail for supporting an item, the bail including a body with an upper head portion; the body having two spaced-apart legs, each leg comprising an upper leg portion and a lower leg portion; the two upper leg portions connected to the upper head portion and projecting down therefrom, the upper leg portions non-parallel to each other and each upper leg portion extending from the upper head portion at an upper angle to a centerline of the bail; and each lower leg portion extending down from a corresponding upper leg portion, each lower leg portion at an angle to its corresponding upper leg portion, and projecting out from the centerline of the bail in a reverse bend with respect to its corresponding upper leg portion, each lower leg portion having a bottom end. Such bail may have one or some, in any possible combination, of the following: each leg body having an oval shape in cross-section; wherein the upper angle ranges between 2 degrees and 7 degrees; wherein each lower leg portion extends down at a lower angle to the centerline of the bail and the lower angle ranges between 12 and 16 degrees; wherein a bend is formed at an interface of each upper leg portion and lower leg portion, the bend located to balance bending moments in each bail; wherein each bail has a constant size cross-section throughout the bail body; wherein a first portion of each bail body has a first cross-section size and a second portion of the bail body has a second cross-section size, the first cross-section size different from the second cross-section size; and/or wherein the first portion is located in an area of the bail at a top of the bail that is an area of relatively high bending moment and the first cross-section size is larger than the second cross-section size.

The present invention, therefore, provides in some, but not in necessarily all, embodiments a bail for supporting a top drive for well operations, the bail including a body with an upper head portion; the body having two spaced-apart legs, each leg comprising an upper leg portion and a lower leg portion; the two upper leg portions connected to the upper head portion and projecting down therefrom, the upper leg portions non-parallel to each other and each upper leg portion extending from the upper head portion at an upper angle to a centerline of the bail; each lower leg portion extending down from a corresponding upper leg portion, each lower leg portion at an angle to its corresponding upper leg portion, and projecting out from the centerline of the bail at a lower angle in a reverse bend with respect to its corresponding upper leg portion; wherein the upper angle ranges between 2 degrees and 7 degrees; wherein the lower angle ranges between 12 and 16 degrees; and the reverse bend located to balance bending moments in each bail.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. What follows are some of the claims for some of the embodiments and aspects of the present invention, but these claims are not necessarily meant to be a complete listing of nor exhaustive of every possible aspect and embodiment of the invention. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A top drive system for wellbore operations, the top drive system comprising a top drive apparatus, bails for supporting the top drive apparatus and from which the top drive apparatus is suspended, the bails comprising a first bail and a second bail, each of the first bail and second bail comprising a generally oval cross-sectional shaped body with an upper head portion, the body having two spaced-apart legs, each leg comprising an upper leg portion and a lower leg portion, the two upper leg portions connected to the upper head portion and projecting down therefrom, the upper leg portions non-parallel to each other and each upper leg portion extending from the upper head portion at an upper angle to a centerline of the bail, and each lower leg portion extending down from a corresponding upper leg portion, each lower leg portion at an angle to a corresponding upper leg portion, and projecting out from the centerline of the bail in a reverse bend with respect the corresponding upper leg portion, each lower leg portion having a bottom end and wherein a bend is formed at the interface of each upper leg portion and lower leg portion, the bend located to balance bending moments in each bail.

2. The top drive system of claim 1 wherein the upper angle ranges between 2 degrees and 7 degrees.

3. The top drive system of claim 1 wherein each lower leg portion extends down at a lower angle to a centerline of the bail and the lower angle ranges between 12 and 16 degrees.

4. The top drive system of claim 1 wherein the upper angle is 5.9 degrees.

5. The top drive system of claim 1 wherein the lower angle is 13.6 degrees.

6. The top drive system of claim 2 wherein each bail has a constant size cross-section throughout the bail body.

7. The top drive system of claim 1 wherein a first portion of each bail body has a first cross-section size and a second portion of the bail body has a second cross-section size, the first cross-section size different from the second cross-section size.

8. The top drive system of claim 7 wherein the first portion is located in an area of the bail at a top of the bail that is an area of relatively high bending moment and the first cross-section size is larger than the second cross-section size.

9. A top drive system for wellbore operations, the top drive system comprising a top drive apparatus, bails for supporting the top drive apparatus and from which the top drive apparatus is suspended, the bails comprising a first bail and a second bail, each of the first bail and second bail comprising a generally oval cross-sectional shaped body with an upper head portion, the body having two spaced-apart legs, each leg comprising an upper leg portion and a lower leg portion, the two upper leg portions connected to the upper head portion and projecting down therefrom, the upper leg portions non-parallel to each other and each upper leg portion extending from the upper head portion at an upper angle to a centerline of the bail, each lower leg portion extending down from a corresponding upper leg portion, each lower leg portion at an angle to a corresponding upper leg portion, and projecting out from the centerline of the bail in a reverse bend with respect to a corresponding upper leg portion, each lower leg portion having a bottom end, wherein the upper angle ranges between 2 degrees and 7 degrees, wherein each lower leg portion extends down at a lower angle to the centerline of the bail and the lower angle ranges between 12 and 16 degrees, and the reverse bend in each bail located to balance bending moments in each bail.

10. A bail for supporting an item, the bail comprising a body with an upper head portion, the body having a generally oval cross-sectional shape and two spaced-apart legs, each leg comprising an upper leg portion and a lower leg portion, the two upper leg portions connected to the upper head portion and projecting down therefrom, the upper leg portions non-parallel to each other and each upper leg portion extending from the upper head portion at an upper angle to a centerline of the bail, and each lower leg portion extending down from a corresponding upper leg portion, each lower leg portion at an angle to a corresponding upper leg portion, and projecting out from the centerline of the bail in a reverse bend with respect to a corresponding upper leg portion, each lower leg portion having a bottom end, and wherein a bend is formed at the interface of each upper leg portion and lower leg portion, the bend located to balance bending moments in the bail.

11. The bail of claim 10 further comprising each leg body having an oval shape in cross-section.

12. The bail of claim 10 wherein the upper angle ranges between 2 degrees and 7 degrees.

13. The bail of claim 10 wherein each lower leg portion extends down at a lower angle to the centerline of the bail and the lower angle ranges between 12 and 16 degrees.

14. The bail of claim 10 wherein each bail has a constant size cross-section throughout the bail body.

15. The bail of claim 10 wherein a first portion of each bail body has a first cross-section size and a second portion of the bail body has a second cross-section size, the first cross-section size different from the second cross-section size.

16. The bail of claim 15 wherein the first portion is located in an area of the bail at a top of the bail that is an area of relatively high bending moment and the first cross-section size is larger than the second cross-section size.

17. A bail for supporting a top drive for well operations, the bail comprising a body with an upper head portion, the body having a generally oval cross-sectional shape and two spaced-apart legs, each leg comprising an upper leg portion and a lower leg portion, the two upper leg portions connected to the upper head portion and projecting down therefrom, the upper leg portions non-parallel to each other and each upper leg portion extending from the upper head portion at an upper angle to a centerline of the bail, each lower leg portion extending down from a corresponding upper leg portion, each lower leg portion at an angle to a corresponding upper leg portion, and projecting out from the centerline of the bail at a lower angle in a reverse bend with respect to a corresponding upper leg portion, wherein the upper angle ranges between 2 degrees and 7 degrees, wherein the lower angle ranges between 12 and 16 degrees, and wherein a bend is formed at the interface of each upper leg portion and lower leg portion, the bend located to balance bending moments in the bail.

* * * * *